United States Patent [19]

Fujiwara

[11] 3,971,009

[45] July 20, 1976

[54] KEY RELEASE TYPE BURGLAR ALARM

[76] Inventor: Akinobu Fujiwara, No. 593-38, Naganuma-cho, Hachioji, Tokyo, Japan

[22] Filed: Jan. 31, 1975

[21] Appl. No.: 546,122

[30] Foreign Application Priority Data

Sept. 17, 1974 Japan ..... 49-111859[U]

[52] U.S. Cl. ..... 340/276; 200/61.66; 200/61.79; 340/274 R

[51] Int. Cl.[2] ..... G08B 13/00

[58] Field of Search ..... 340/283, 274 R, 276; 200/61.66, 42 R, 61.79

[56] References Cited

UNITED STATES PATENTS

| | | | |
|---|---|---|---|
| 3,596,014 | 7/1971 | Erez | 340/274 R |
| 3,685,036 | 8/1972 | Torok | 340/274 R |
| 3,771,154 | 11/1973 | Takei | 340/274 R |

*Primary Examiner*—Glen R. Swann, III

*Attorney, Agent, or Firm*—Wenderoth, Lind & Ponack

[57] ABSTRACT

A switching device for a burglar alarm includes an electrically conductive cylindrical ring-like housing and an electrically conductive contact element inserted into said housing and resiliently held against the contact housing to form a closed circuit. A key of specific structure and length is inserted against the contact element to force it away from the side of the cylindrical housing and thereby break the closed circuits and render the alarm inoperable. A retainer is also provided adjacent the key for holding the key in position against the contact element, thus assuring that the circuit remains open.

4 Claims, 6 Drawing Figures

KEY RELEASE TYPE BURGLAR ALARM

BACKGROUND OF THE INVENTION

The present invention relates to an audio alarm which is to be installed on an entrance door, for example, to warn an unauthorized intrusion and includes an electrical switching arrangement which is only energized to turn the alarm on when any key other than a specified key is used.

A known alarm of this type has a circuit consisting of two switches, and is only actuated to render the alarm inoperative when the two switches are both placed in an "ON" position, thereby concluding the circuit. According to the known alarm, at least one of the two switches is used to place the alarm ready to signal a warning or on the alert, or off the alert. A number of different constructions have heretofore been known as switching means of placing the alarm on the alert or off the alert. A generally known switch has contacts simply placed apart, and is actuated when the contacts are electrically connected. The switching circuit is therefore easily interrupted by interposing an electrically insulated element between the two contacts. It will be easily understood that the known alarm has disadvantages since any person who knows the switching circuit arrangement may readily render the circuit or alarm inoperative by using his key so constructed.

SUMMARY OF THE INVENTION

It is one object of the present invention to provide an audio alarm including an electrical switching arrangement which is only actuated to render the alarm inoperative when a specified key is used.

It is another object of the present invention to provide an audio alarm which cannot be rendered inoperative by any person who knows the internal structure of the alarm.

It is a further object of the present invention to provide an audio alarm including an electrical switching circuit which is always actuated to turn the alarm on when a key of any length and size other than that specified is used.

In order to attain the above objects, the present invention provides an audio alarm including an electrical switching circuit which comprises an electrically conductive cylindrical housing formed like a ring and an electrically conductive contact element inserted inside the cylindrical housing, and is only actuated to render the alarm inoperative when a fitting key of a specified construction is used, because the contact element is held by the fitting key in a neutral position with respect to the housing or out of contact with the housing thereby breaking the switching circuit.

The above objects and advantages of the present invention will become apparent from the following specification with reference to the accompanying drawings.

DESCRIPTION OF THE PREFERRED EMBODIMENTS

Figure 1:
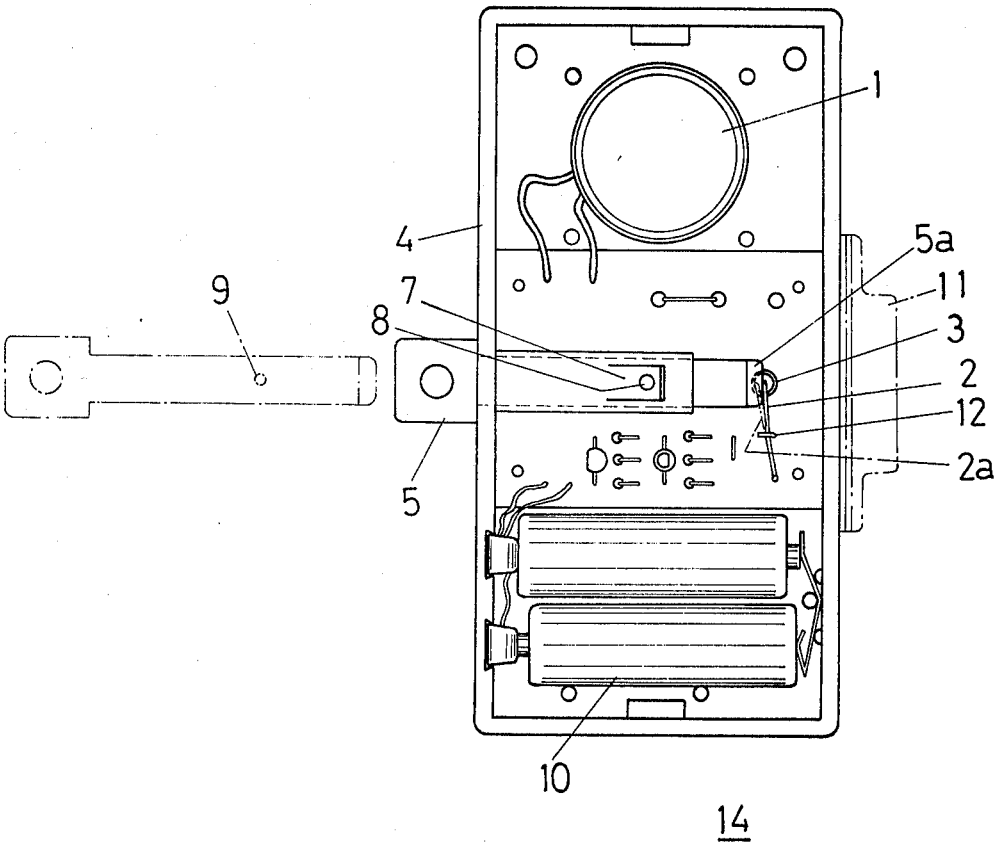
FIG. 1 is a plan view of an audio alarm embodying the present invention, in which its top cover is removed.
Figure 2:
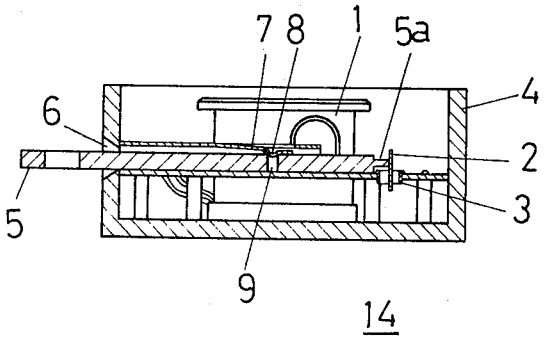
FIG. 2 is a vertical sectional front view showing a fitting key insertion portion.

The present invention will now be further described by way of several preferred embodiments thereof with reference to the accompanying drawings in which:

Referring first to FIG. 1, there is shown a buzzer 1 having an electrical circuit which includes an electrical switching arrangement connected to the buzzer 1, said switching arrangement comprising a substantially L-shaped contact element 2 of electrically conductive material and a cylindrical housing or element 3 of electrically conductive material and formed like a ring. The contact element 2 has one end inserted inside the cylindrical housing 3 and is normally urged by its resilient action toward the key insertion side so as to be in contact with the inner-side wall of the housing 3; the other end is permanently fixed.

A casing 4 has a key insertion hole 6 on the lateral wall thereof, said hole 6 extending inside the casing 4. A fitting key 5 is of a specified length to allow it, when inserted, to place the contact element 2 in a neutral relative to the housing 3, and has an opening 9 (or a concave or depressed portion may be provided) at a specified location to engage with a protrusion 8 provided on a key retaining element 7 of elastic material. The length of the fitting key 5 should be such as to allow its end 5a to place the contact element 2 in a neutral position, clear of the housing 3, when the opening 9 of the key 5 engages with the protrusion 8 of the element 7. Reference numeral 10 denotes dry cells arranged in series, numeral 11 denotes a magnet to actuate a magnet switch (not shown), and numeral 12 denotes a stopper for holding the contact element 2.

In the embodiment above described, when the fitting key 5 is inserted, it places the contact element 2 in a neutral position and holds it out of contact with the housing 3 as shown by the solid lines in FIG. 1, so that the buzzer 1 is placed in an open circuit. Reversely, when the key 5 is withdrawn, the contact element 2 is urged by its resilient action toward the inner-side wall of the housing 3 as shown by the dot-dash lines in FIG. 1 and is brought in contact with the housing 3 to place the buzzer 1 in a closed circuit. When a door with the magnet 11 installed thereon, for example, is opened with the buzzer circuit closed, it places the magnet switch in a closed circuit so that the buzzer circuit is complete and able to signal warning sounds. If any other insertion means of electrically insulating material other than specified should be tried to render the alarm inoperative, it is extremely difficult or impossible to interrupt the buzzer circuit as such insertion means, too short or too long, cannot hold the contact element in a neutral position as long as it is not so constructed as specified.

Because the key according to the invention is available in various modifications in which a protrusion 8 and an opening 9 opposite the protrusion 8 may be provided in any desired locations, no keys other than those specified will fulfill the purpose.

Figure 3:
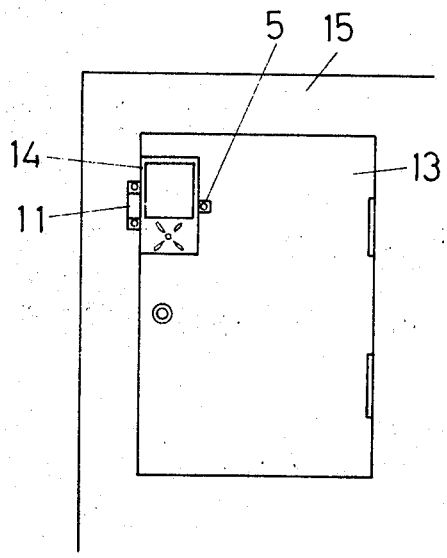
FIG. 3 is a front view of one example of application in which an alarm is installed on a hinged door.
Figure 4:
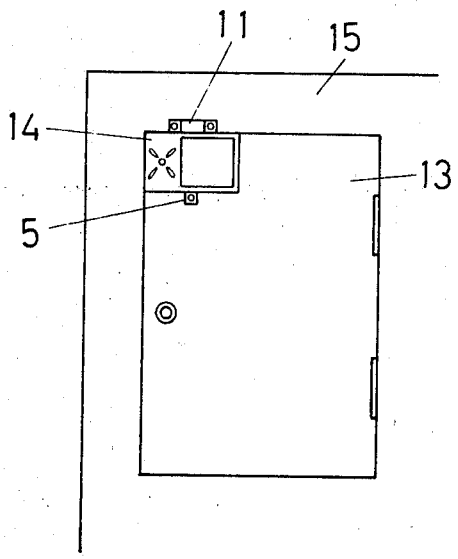
FIG. 4 is a front view of another example in which an alarm is installed on a hinged door.
Figure 5:
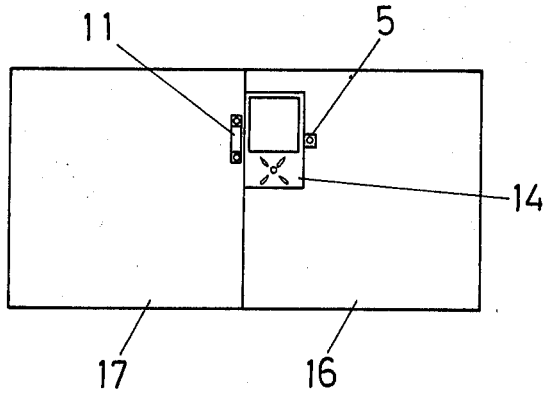
FIG. 5 is a front view of a third example in which an alarm is installed on a sliding door.
Figure 6:
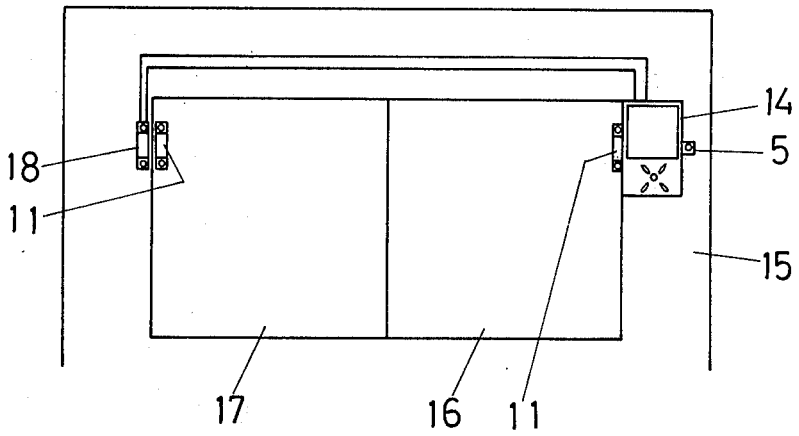
FIG. 6 is a front view of a fourth example in which an alarm is installed on a sliding door.

Referring next to FIGS. 3 to 6, there are shown a number of examples of applications in which the alarm is installed on different types of doors. In FIGS. 3 and 4, an alarm body 14 is installed on a hinged door 13 with a magnet 11 installed on a circumferential wall surrounding the door 13 and opposite the alarm body 14. FIGS. 5 and 6 show two examples in which an alarm is installed on a set of sliding doors 16, 17. In FIG. 5, there is shown the alarm body 14 installed on one door 16 with a magnet 11 on the other 17. In FIG. 6, there are shown two magnets 11, 11 each installed on its respective sliding door 16, 17 with an alarm body 14 installed opposite one of the magnets on the circumferential wall 15 of the door and with an additional magnet switch 18 installed opposite the other magnet 11 on the wall 15 and connected in parallel with a magnet switch provided inside the alarm body 14.

It is to be noted that the audio alarm according to the invention can be installed in any desired position such as vertically or otherwise, provided that the magnet switch and the magnet are placed in a properly spaced relation opposite each other.

In FIGS. 3 to 6, the alarm body 14 has a fitting key 5 inserted therein which places the alarm in an "OFF ALERT" condition. If the key 5 is then withdrawn, the alarm is placed in an "ON ALERT" condition.

As indicated in FIG. 6, the number of magnetic switches can be increased. If additional magnet switches are therefore placed in a number of different doors and connected to one alarm body, all doors can be controlled by a single alarm.

It is clearly to be understood that because the alarm according to the invention includes an electrical switching arrangment comprising the cylindrical housing and the contact element inserted inside the housing, said housing and said contact element normally forming a closed circuit, it is advantageous in that the switching circuit is only interrupted for rendering the alarm inoperative when the specified fitting key is used. Any other key of a length not specified will always bring the contact element into contact with the housing, thus readying the alarm to signal warning sounds. By properly determining the inner diameter of the housing and the size of the contact element, it is possible to provide an alarm whose switching action is very responsive and reliable.

Although the invention has been described with reference to several preferred embodiments thereof, it is to be understood that changes and modifications may be made be made within the scope and spirit of the invention.

What I claim:

1. An electrical switching device for use in an alarm system circuit, said device comprising:

ring-like cylindrical element of electrically conductive material electrically connected to said alarm circuit;

contact means of electrically conductive material fitted through said cylindrical element and electrically connected to said alarm circuit for resiliently contacting the inside surface of said cylindrical element and forming a completed alarm circuit;

a key removably positioned against said contact means for forcing said contact means away from said inside surface of said cylindrical element and breaking said completed alarm circuit; and retainer means adjacent said key for retaining said key in a predetermined position against said contact means, whereby the alarm circuit is held open.

2. A device as claimed in claim 1, wherein said contact means is comprised of a substantially L-shaped contact element, the shorter portion thereof fitted through and resiliently forced against the inside surface of said cylindrical element.

3. A device as claimed in claim 1 wherein:

said key is only of sufficient length to force said contact means toward the center of said cylindrical element away from contact with said inside surface, thereby breaking the alarm circuit;

said key has an opening therein; and said retainer means has a protrusion thereon engageable with said opening in said key when said key forces said contact means toward the center of said cylindrical element, whereby said key is retained in position by said retainer means against said contact means.

4. A device as claimed in claim 3, wherein said opening in said key is a depressed or concave portion therein for engaging with the protrusion on said retainer means.

* * * * *